US006111934A

United States Patent [19]

Foerst et al.

[11] Patent Number: 6,111,934

[45] **Date of Patent: *Aug. 29, 2000**

[54] X-RAY TUBE WITH ELECTROMAGNETIC ELECTRON BEAM DEFLECTOR FORMED BY LAMINATING IN PLANES ORIENTED PERPENDICULARLY TO THE ELECTRON BEAM

[75] Inventors: Bernhard Foerst, Ebermannstadt; Marion Meusel; Roland Schmidt, both of Erlangen, all of Germany

[73] Assignee: Siemens Aktiengesellschaft, Munich, Germany

[ * ] Notice: This patent is subject to a terminal disclaimer.

[21] Appl. No.: 09/161,679

[22] Filed: Sep. 28, 1998

[30] Foreign Application Priority Data

Sep. 30, 1997 [DE] Germany ..... 197 43 163

[51] Int. Cl.[7] ..... H01J 35/30

[52] U.S. Cl. ..... 378/137; 378/121; 378/136; 378/138

[58] Field of Search ..... 378/119, 121, 378/136, 137, 138

[56] References Cited

U.S. PATENT DOCUMENTS

| | | | |
|---|---|---|---|
| 5,132,544 | 7/1992 | Glavish | 250/492.2 |
| 5,313,510 | 5/1994 | Ebersberger et al. | 378/12 |
| 5,703,926 | 12/1997 | Bischof | 378/200 |
| 5,812,632 | 9/1998 | Schardt et al. | 378/137 |
| 5,822,395 | 10/1998 | Schardt et al. | 378/137 |
| 5,883,936 | 3/1999 | Hell et al. | 378/125 |
| 5,898,755 | 4/1999 | Meusel et al. | 378/137 |
| 5,909,479 | 6/1999 | Rother | 378/121 |
| 6,055,294 | 4/2000 | Foerst et al. | 378/138 |

*Primary Examiner*—David P. Porta
*Assistant Examiner*—Allen C. Ho
*Attorney, Agent, or Firm*—Hill & Simpson

[57] ABSTRACT

An x-ray tube has a cathode and an anode arranged in a vacuum housing, wherein an electron beam emanating from the cathode is incident at a focal spot on the anode. An electromagnet is provided for deflecting the electron beam, this electromagnet having a U-shaped yoke with two legs connected by a base section with a winding surrounding the base section. The electron beam passes between the two legs. The yoke is formed by successively layered laminations disposed in respective planes disposed substantially perpendicularly to the propagation direction of the electron beam.

12 Claims, 2 Drawing Sheets

X-RAY TUBE WITH ELECTROMAGNETIC ELECTRON BEAM DEFLECTOR FORMED BY LAMINATING IN PLANES ORIENTED PERPENDICULARLY TO THE ELECTRON BEAM

BACKGROUND OF THE INVENTION

1. Field of the Invention

The present invention relates to an x-ray tube with a cathode and an anode arranged in a vacuum housing wherein the electron beam emanating from the cathode is incident at a focal spot on the anode, of the type wherein means for deflecting the electron beam are provided.

2. Description of the Prior Art

The possibility of deflection of the electron beam and thus deflecting the focal spot is of particular importance in connection with computed tomography since, as is known, by displacing the focal spot between two end (extreme) positions an improvement in the image quality can be achieved due to the thusly achieved multiplication of the data available for the calculation of the image of a body slice.

An x-ray tube of the abovementioned type is described in German OS 41 25 926, wherein the means for deflection of the electron beam are formed by an air coil arranged outside the vacuum housing. This air coil is designed in a manner which causes it to occupy a considerable volume. In addition, considerable electrical power must be fed to the air coil to effect a defined deflection of the electron beam, so that a great deal of dissipated heat is released in undesirable fashion in connection with the deflection of the electron beam, which presents a further disadvantage in view of the thermal problems arising in the operation of x-ray tubes anyway. Nevertheless, the air coil has good transmitting properties even in the case of actuation with signals of higher frequency or with signals containing portions of higher frequency. Such signals are employed in new computed tomography systems for deflection of the electron beam.

SUMMARY OF THE INVENTION

An object of the present invention is to provide an x-ray tube of the abovementioned type such that the electrical power required for deflection of the electron beam, the power loss arising in the deflection of the electron beam, and the spatial requirement for the assembly of the means for deflecting the electron beam are low, yet there are good transmitting properties in the case of actuation of the means for deflection of the electron beam with signals of higher frequency (>20 kHz) or signals containing higher-frequency components.

The object is inventively achieved in an x-ray tube with a cathode and an anode arranged in a vacuum housing wherein the electron beam emanating from the cathode is incident at a focal spot on the anode, wherein an electromagnet is provided for deflection of the electron beam, this magnet having a U-shaped yoke with two legs connected by a base section as well as a winding surrounding the base section, wherein the electron beam passes between the two legs and wherein the yoke is formed by laminations layered in succession which are disposed in respective planes that lie, preferably substantially, at a right angle substantially orthogonally, to the direction of the electron beam.

In the case of the inventive x-ray tube the means for deflection of the electron beam are thus formed by an electromagnet. The laminations of its yoke are arranged such that they reside in planes disposed essentially at a right angle to the direction of the electron beam, i.e. they run parallel to the direction of the magnetic field lines. A uniform flow density of the magnetic flux including all laminations thereby results in the yoke. Better transmission properties thereby result in the range of the higher frequencies—i.e., at least for the harmonics of the fundamental of the signals fed to the winding, which is essential for good transmitting properties in the case of saw-toothed, trapezoidal or triangular signals. Besides, the losses in the yoke are slight, so that a low power is sufficient for actuation of the winding, and the dissipated energy converted into heat is likewise slight.

German OS 196 45 053 (published after the convention priority date to which the present application is entitled), corresponding to co-pending U.S. application Ser. No. 08/955,257, filed Oct. 21, 1997 and assigned to the same assignee (Siemens AG) as the present application, discloses an x-ray tube of the abovementioned type with an electromagnet having a yoke constructed of thin laminations, however, the laminations are not arranged such that the electron beam is oriented at a right angle to the planes (surfaces) of the laminations. Rather, the laminations are arranged such that the electron beam proceeds parallel to the planes of the laminations.

If, according to one version of the invention, the electron beam travels on its path to the anode in a shaft-shaped housing part of the vacuum housing located between the yoke legs, it is guaranteed that the legs of the yoke are located close to the electron beam to be deflected, with the result that the power that needs to be fed to the winding in order to effect a defined deflection of the electron beam is even lower, and the power loss arising in the deflection of the electron beam decreases even more. In addition the electromagnet can be small and cost-effective. Particularly favorable results are achieved if the cross-section of the shaft-shaped housing part does not significantly exceed the size required for an unobstructed passage of the electron beam.

Defocusing of the electron beam can be minimized if the electromagnet is arranged according to one embodiment of the invention such that the electron beam intersects a straight line at approximately its midpoint, this line intersecting the center axes of the parallel legs at a right angle as well as the primary direction of propagation of the electron beam. Consequently, due to the symmetry of the magnetic field relative to the plane containing the center axes of the parallel legs of the yoke, the electron beam assumes a course that largely guarantees that the defocusing interactions arising on the path of the electron beam through the part of the magnetic field located on the one side of this plane are cancelled on the path of the electron beam through the part of the magnetic field located on the other side of said plane.

The "primary" direction of propagation of the electron beam "as used herein" means the direction of the electron beam at the point of passage through the plane containing the center axes of the two parallel sections of the legs of the yoke when the electron beam is at the center position which lies between the two end positions that can be attained by the deflection of the electron beam.

To guarantee that a homogenous magnetic field over a sufficiently large area is present, in a version of the invention the length of the legs is longer than the greatest extent of the shaft-shaped housing part in the direction of the center axes of the parallel sections of the legs.

DESCRIPTION OF THE PREFERRED EMBODIMENTS

Figure 1:
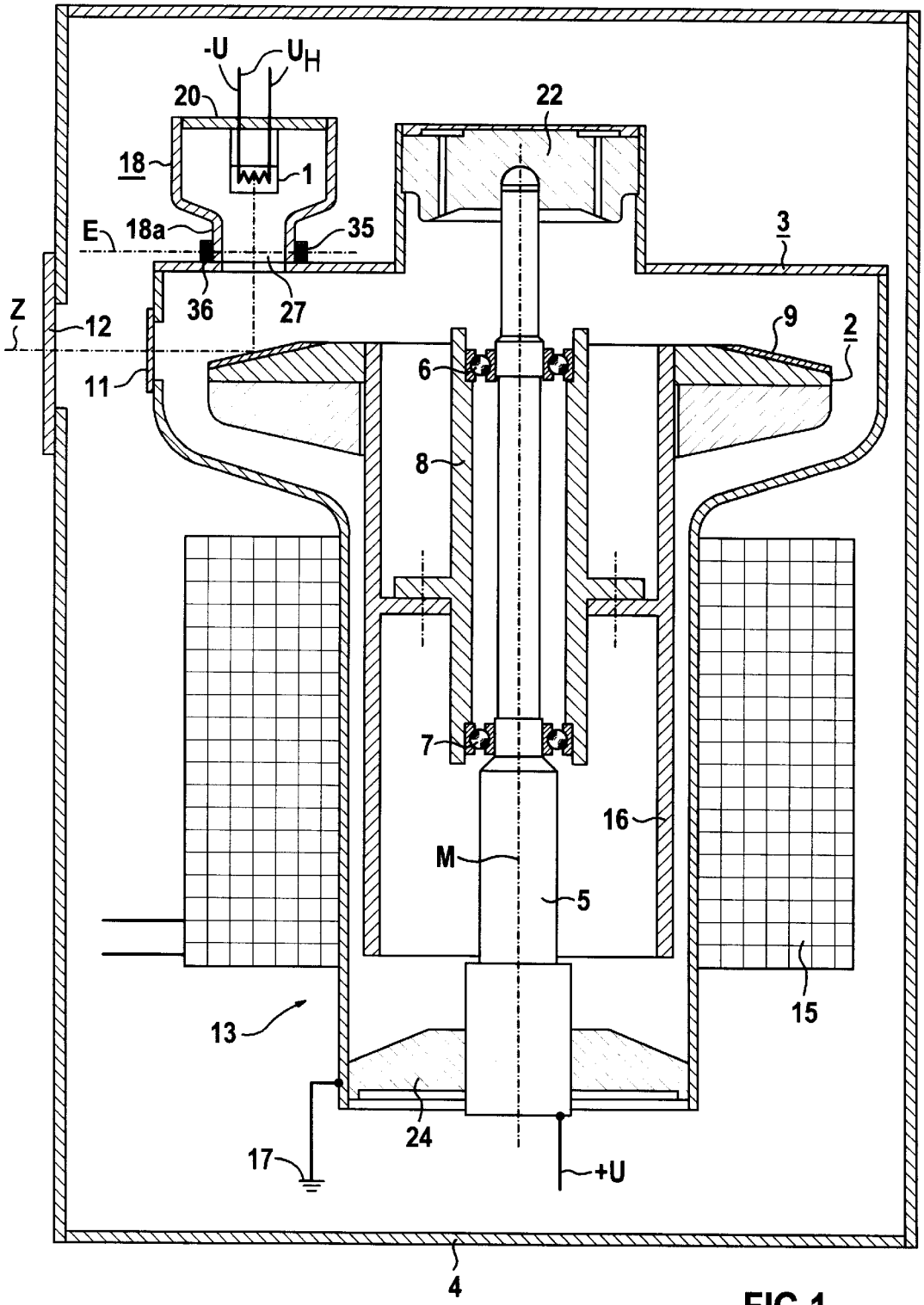
FIG. 1 is a schematic depiction of an inventive x-ray tube in longitudinal section.

The x-ray tube according to FIG. 1 has a stationary cathode 1 which emits an electron beam 10, and a rotating anode referenced 2 overall, which are arranged in a vacuum-tight, evacuated vacuum housing 3 which is accepted in a protective housing 4 filled with an electrically insulating liquid coolant such as insulating oil. The rotating anode 2 is rotatably mounted on a stationary axle 5 in the vacuum housing 3 by means of two rolling bearings 6, 7 and a bearing sleeve 8.

Figure 3:
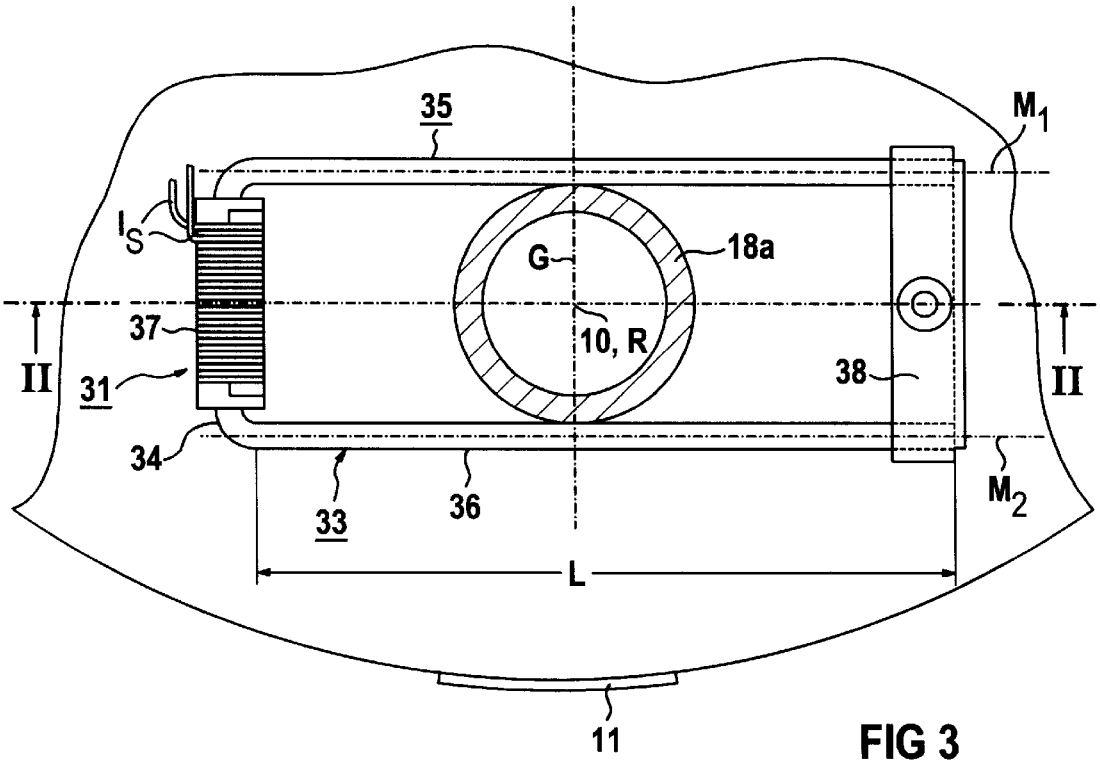
FIG. 3 shows a portion of a section along the line III—III in FIG. 2.

The rotating anode 2, fashioned rotational-symmetrically to the center axis M of the axle 5, has a target surface which is provided with a layer 9 of a tungsten-rhenium alloy, for example, at which the electron beam 10 strikes for generating an x-ray beam. (FIGS. 1 and 3 depict only the center axis of the electron beam 10 in dashed fashion). The corresponding useful x-ray beam—of which only the center beam Z is depicted in FIG. 1—exits through the radiation exit windows 11 and 12 which are provided in the vacuum housing 3 and in the protective housing 4 and arranged in true alignment with each other.

An electromotor fashioned as a squirrel-cage motor and referenced 13 overall is provided for driving the rotating anode 2. The motor 13 has a stator 15 placed on the vacuum housing 3 and a rotor 16 located within the vacuum housing and connected to the rotating anode 2 in rotationally secure fashion.

A funnel-shaped housing portion 18 is attached to the vacuum housing 3 and is connected to ground 17 and which is formed of metallic materials, except for an insulator 20 supporting the cathode 1 and two insulators 22 and 24 accepting the axle 5. The housing portion 18 is connected to the vacuum housing 3 via a shaft-shaped housing part 18*a*. The cathode 1 is attached to the funnel-shaped housing portion 18 by means of the insulator 20. The cathode 1 is thus located in a special chamber of the vacuum housing 3, which is connected thereto via the shaft-shaped housing part 18*a*.

The positive high voltage +U for the rotating anode 2 is connected to the axle 5 which is accepted in the insulator 22 in vacuum-tight fashion. The tube current thus flows via the rolling bearings 6 and 7.

As can be seen in the schematic depiction of FIG. 1, the negative high voltage −U is at the first terminal of the cathode 1. The heating voltage UH is across the two terminals of the cathode 1. The cables leading to the cathode 1, the axle 5, the vacuum housing 3 and the stator 15 are connected in known fashion with a power supply (not depicted) located outside the protective housing 4, this power supply delivering the voltages required for operation of the x-ray tube. It is clear from the preceding explanations that the x-ray tube according to FIG. 1 is a bipolar-type tube.

It is clear from FIG. 1 that the electron beam 10 emanating from the cathode 1 passes through the shaft-shaped housing part 18*a* on its way to the rotating anode 2. The shaft-shape housing part 18*a* thus borders a diaphragm aperture 27. The dimensions thereof are selected such that they do not significantly exceed the dimensions required for an unobstructed passage of the electron beam 10.

The funnel-shaped housing part 18 and the upper wall of the vacuum housing 3 in FIG. 1 (at least these parts, though preferably all the metallic parts of the vacuum housing 3, are made of non-magnetic materials such as special steel) thus border an annular space in which an electromagnet 31 is arranged (schematically shown in FIG. 1) which serves to generate a magnetic deflecting field for the electron beam 10 which deflects this beam perpendicularly to the plane of FIG. 1, this space being located outside the vacuum housing 3 and being radially open to the outside.

The electromagnet 31 has a U-shaped yoke 33 with two legs 35, 36 connected by a base section 34 and a winding 37 that surrounds the base section 34. The electromagnet 31 is arranged such that the shaft-shaped housing part 18*a* is located between the two legs 35, 36 of the yoke 33, which adjoin the shaft-shaped housing part 18*a*.

Via its terminals $I_S$ the winding 37 of the electromagnet 31 is connected with a power source (not depicted) that allows a current to flow through the winding 37 in the operation of the x-ray tube. If the current flowing through the winding is a direct current, then the electron beam 10 is statically deflected, so that the static position of the focal spot can be set. In the utilization of the x-ray tube in computed tomography, for example, it is possible in this way to set the position of the focal spot relative to the center of rotation of the gantry of the computed tomography apparatus and to the radiation detector attached to the gantry opposite the x-ray tube. If a periodic deflection of the electron beam 10 is desired, the current delivered by the deflecting circuit has a sinusoidal, preferably saw-toothed, trapezoidal or triangular characteristic, for example.

The yoke 33 is constructed from thin laminations and is formed such that the legs 35, 36 have respective center axes $M_1$, $M_2$ which proceed substantially parallel to each other and which reside in a common plane E. The two legs 35, 36, which are straight lines in the described exemplary embodiment, have a length L which is greater than the greatest extent (largest dimension) of the shaft-shaped housing part 1 8*a* in the direction of the center axes $M_1$, $M_2$ of the legs 35, 36. It is understood that to avoid impairment of the magnetic properties, the laminations need to be annealed following their processing (cutting and bending) in order to undo lattice modifications caused by the processing.

Figure 2:
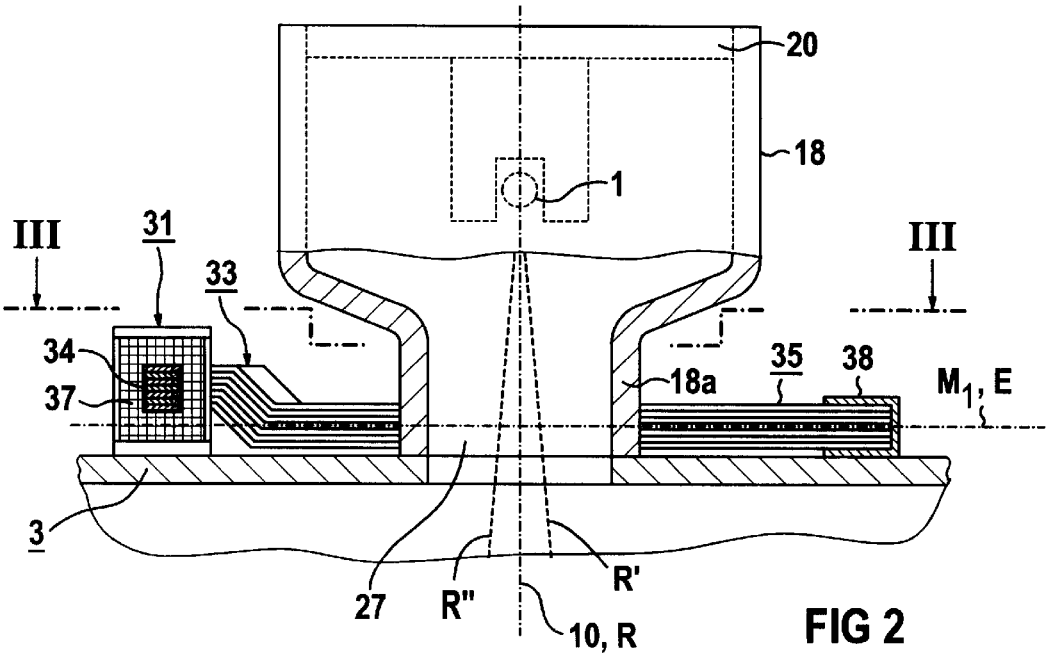
FIG. 2 shows a portion of a section along the line II—II in FIG. 3.

As is clear from FIGS. 2 and 3, the laminations are arranged such that they lie in planes which are disposed substantially at a right angle, and preferably substantially orthogonally, to the direction of the electron beam 10, i.e. they proceed parallel to the direction of the magnetic field lines. This results in a uniform flow density of the magnetic flux in the yoke 33, including all laminations. Better transmission properties in the range of higher frequencies thereby result, i.e. at least for the higher harmonics of the saw-toothed, trapezoidal or triangular signals fed to the winding 37. Additionally, the losses in the yoke 33 are lower, so that a lower power is adequate for actuating the winding, and the dissipated energy converted into heat decreases.

The electromagnet 31 is attached to the vacuum housing such that the primary direction of propagation of the electron beam 10 (dashed line) proceeds substantially orthogonally to the plane E containing the center axes of the legs 35, 36, as can be seen in FIG. 1 in conjunction with FIGS. 2 and 3, wherein the respective paths of the electron beam for the two end (extreme) positions attainable by the deflection of the electron beam is also depicted in dotted fashion and are referenced R' and R" in FIG. 3.

The electromagnet 31 is arranged such that the electron beam 10 intersects a straight line G substantially at its midpoint, this line G intersecting the primary direction of propagation of the electron beam 10 and the center axes $M_1$, $M_2$ of the legs 35, 36 substantially at a right angle. Thus, as is evident from FIGS. 2 and 3, the electron beam 10 is disposed at a distance from the ends of the legs 35, 36 which is greater than the distance between the legs 35, 36 in the region of the electron beam 10.

The electron beam 10 is thus not located in the region of maximum field strength in the region of the ends of the legs 35, 36, but rather in the region of the stray field, which is, however, very homogenous between the legs 35, 36, at a distance from their ends, this representing the basic precondition for the avoidance of defocusing interactions.

As a result of the described design of the electromagnet 31, its magnetic field is symmetrical to the plane E containing the center axes $M_1$, $M_2$ of the legs 35, 36. As a consequence of this and of the described arrangement of the electromagnet 31 relative to the vacuum housing 3, defocusing interactions which arise when the electron beam 10 passes through the part of the magnetic field located on one side of the plane E on its path through the shaft-shape housing part 18*a* are virtually completely cancelled when the electron beam 10 passes through the part of the magnetic field located on the other side of the plane E.

By means of the described arrangement of the electromagnet 31 it is further achieved that the legs 35, 36 of the yoke 33 can be located very close to the electron beam 10, and thus only a low power is required for deflecting the electron beam. This also allows the dissipated energy of the electromagnet 31 to be conveyed to the coolant located in the protective housing 4 without complications.

In addition, the electromagnet 31 is very compact and can be easily fixed at the vacuum housing 3 with a clamping part 38 that is screwed to the vacuum housing 3.

It is understood that the size of the deflection of the electron beam 10 produced by the electromagnet 31 is taken into consideration in the dimensioning of the shaft-shaped housing part 18*a* and thus of the diaphragm aperture 27.

Since the vacuum housing 3 is at ground potential and thus at a more positive potential than the cathode 1, a large part of the electrons scattered back by the rotating anode 2 are intercepted by the regions of the vacuum housing 3 bordering the diaphragm aperture 27 and by the adjoining regions. Apart from its primary object, the vacuum housing 3—particularly in the region of the housing part 18*a*—thus fulfils the function of a diaphragm for reduction of the extrafocal radiation.

Since the housing part 18*a* which essentially borders or includes the diaphragm aperture 27, is in direct contact with the coolant located in the protective housing 4 (except for a small region wherein the legs 35, 36 of the yoke 33 are adjacent at the exterior of the housing part 18*a*) a good cooling is guaranteed, so that thermal problems cannot arise.

As noted above, the x-ray tube depicted in FIG. 1 is a type of tube known as a bipolar x-ray tube. The invention can also be employed, however, in a type of tube known as a unipolar x-ray tube. The vacuum housing 3 and the rotating anode 2 then are at the same potential, namely ground potential 17, while cathode 1 is at the negative high voltage −U. In order for both the rotating anode 2 and the vacuum housing 3 to be at ground potential 17, an end shield formed from an electrically conductive material can be provided instead of the insulator 22 and/or the insulator 24, so that there is an electrically conductive connection between the rotating anode 2 and the vacuum housing 3. Alternatively or additionally, the axle 5 can be connected to ground potential 17.

In the case of the described exemplary embodiment, the electromagnet 31 is located entirely outside the vacuum housing 3. It is also possible, however, to arrange the electromagnet 31 entirely or partially within the vacuum housing 3; in the latter case the winding 37 is preferably located outside the vacuum housing 3.

Although the invention was explained herein in the context of an x-ray tube with rotating anode, it can also be used in an x-ray tube with a stationary anode.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray tube comprising:

a vacuum housing;

a cathode and an anode disposed in said vacuum housing, said cathode emitting an electron beam which propagates in a propagation direction toward said anode and which is incident on said anode at a focal spot;

an electromagnet which generates a magnetic field with which said electron beam interacts, for deflecting said electron beam in a path between said cathode and said anode, said electromagnet comprising a U-shaped yoke with two legs connected by a base section and an electrical winding around said base section, said electromagnet being disposed relative to said path of said electron beam so that said electron beam passes between said two legs, and said yoke being comprised of a plurality of stacked laminations respectively disposed in planes which are disposed substantially orthogonally to said propagation direction of said electron beam.

2. An x-ray tube as claimed in claim 1 wherein said vacuum housing comprises a hollow, shaft-like projection disposed between said two legs of said yoke, and wherein said path of said electron beam between said cathode and said anode proceeds through said shaft-like housing part.

3. An x-ray tube as claimed in claim 1 wherein said two legs of said yoke have respective sections which are parallel to each other, each of said respective sections having a center axis, and wherein said electron beam intersects substantially a middle of a straight line intersecting said center axes of said sections of said legs substantially at a right angle and intersecting said propagation direction of said electron beam substantially at a right angle.

4. An x-ray tube as claimed in claim 2 wherein each of said two legs of said yoke has a length, and wherein said shaft-like housing part has a largest dimension in a direction of said center axes of said legs, and wherein said length is larger than said largest dimension.

5. An x-ray tube comprising:

a vacuum housing;

a cathode and an anode disposed in said vacuum housing, said cathode emitting an electron beam which propagates in a propagation direction toward said anode and which is incident on said anode at a focal spot;

an electromagnet which generates a magnetic field with which said electron beam interacts, for deflecting said electron beam in a path between said cathode and said anode, said magnetic field having magnetic field lines associated therewith, said electromagnet comprising a U-shaped yoke with two legs connected by a base section and an electrical winding around said base section, said electromagnet being disposed relative to said path of said electron beam so that said electron beam passes between said two legs, and said yoke being comprised of a plurality of stacked laminations respectively disposed in planes which are disposed substantially parallel to said magnetic field lines.

6. An x-ray tube as claimed in claim 5 wherein said vacuum housing comprises a hollow, shaft-like projection disposed between said two legs of said yoke, and wherein said path of said electron beam between said cathode and said anode proceeds through said shaft-like housing part.

7. An x-ray tube as claimed in claim 5 wherein said two legs of said yoke have respective sections which are parallel to each other, each of said respective sections having a center axis, and wherein said electron beam intersects substantially a middle of a straight line intersecting said center axes of said sections of said legs substantially at a right angle and intersecting said propagation direction of said electron beam substantially at a right angle.

8. An x-ray tube as claimed in claim 7 wherein each of said two legs of said yoke has a length, and wherein said shaft-like housing part has a largest dimension in a direction of said center axes of said legs, and wherein said length is larger than said largest dimension.

9. An x-ray tube comprising:

a vacuum housing;

a cathode and an anode disposed in said vacuum housing, said cathode emitting an electron beam which propagates in a propagation direction toward said anode and which is incident on said anode at a focal spot;

an electromagnet which generates a magnetic field with which said electron beam interacts, for deflecting said electron beam in a path between said cathode and said anode, said electromagnet comprising a U-shaped yoke with two legs connected by a base section and an electrical winding around said base section, said electromagnet being disposed relative to said path of said electron beam so that said electron beam passes between said two legs, and said yoke being comprised of a plurality of stacked laminations respectively disposed in planes which are disposed substantially at a right angle to said propagation direction of said electron beam.

10. An x-ray tube as claimed in claim 9 wherein said vacuum housing comprises a hollow, shaft-like projection disposed between said two legs of said yoke, and wherein said path of said electron beam between said cathode and said anode proceeds through said shaft-like housing part.

11. An x-ray tube as claimed in claim 9 wherein said two legs of said yoke have respective sections which are parallel to each other, each of said respective sections having a center axis, and wherein said electron beam intersects substantially a middle of a straight line intersecting said center axes of said sections of said legs substantially at a right angle and intersecting said propagation direction of said electron beam substantially at a right angle.

12. An x-ray tube as claimed in claim 11 wherein each of said two legs of said yoke has a length, and wherein said shaft-like housing part has a largest dimension in a direction of said center axes of said legs, and wherein said length is larger than said largest dimension.

* * * * *